US008752232B2

(12) United States Patent
Otsuka et al.

(10) Patent No.: US 8,752,232 B2
(45) Date of Patent: Jun. 17, 2014

(54) CLEANING SHEET

(75) Inventors: Hiroshi Otsuka, Tochigi (JP); Minoru Wada, Tochigi (JP); Satoshi Nagai, Tochigi (JP)

(73) Assignee: Kao Corporation, Tokyo (JP)

( * ) Notice: Subject to any disclaimer, the term of this patent is extended or adjusted under 35 U.S.C. 154(b) by 429 days.

(21) Appl. No.: 13/144,252

(22) PCT Filed: Feb. 4, 2010

(86) PCT No.: PCT/JP2010/051573
§ 371 (c)(1),
(2), (4) Date: Jul. 12, 2011

(87) PCT Pub. No.: WO2010/092895
PCT Pub. Date: Aug. 19, 2010

(65) Prior Publication Data

US 2011/0277258 A1 Nov. 17, 2011

(30) Foreign Application Priority Data

Feb. 13, 2009 (JP) ..... 2009-031393

(51) Int. Cl.
*A47L 13/16* (2006.01)

(52) U.S. Cl.
USPC ..... 15/209.1; 15/228

(58) Field of Classification Search
USPC ..... 15/210.1, 209.1, 228
See application file for complete search history.

(56) References Cited

U.S. PATENT DOCUMENTS 6,143,393 A 11/2000 Abe et al.
6,241,835 B1 6/2001 Abe et al.
6,245,413 B1 6/2001 Kenmochi et al.
6,329,308 B1 12/2001 Kenmochi et al.
6,813,801 B2 11/2004 Tanaka et al.

(Continued)

FOREIGN PATENT DOCUMENTS

CN 1921793 A 2/2007
EP 0 777 997 A2 6/1997

(Continued)

OTHER PUBLICATIONS

English translation of International Preliminary Report on Patentability (Form PCT/IB/338 and 373) and Written Opinion of the International Searching Authority (Form PCT/ISA/237) issued on Dec. 3, 2009 in PCT/JP2008/058100.

(Continued)

*Primary Examiner* — Shay Karls
(74) *Attorney, Agent, or Firm* — Birch, Stewart, Kolasch & Birch, LLP.

(57) ABSTRACT

A cleaning sheet (1A) includes: a substrate sheet (2); and a plurality of long-fiber bundles (3) provided thereon, each long-fiber bundle (3) being made by aggregating long fibers (31), the long-fiber bundles (3) being arranged side-by-side and joined to the substrate sheet (2). Each long-fiber bundle (3) is joined together by fiber-joining sections (32). Each long-fiber bundle (3) is joined to the substrate sheet (2) by sheet-joining sections (21). Each sheet-joining section (21) is provided so as to overlap one of the fiber-joining sections (32). Each long-fiber bundle (3) has been cut by linear cut sections (24), each linear cut section (24) being formed in a region between adjacent sheet-joining sections (21). Each long-fiber bundle (3) includes cut fibers (311) and uncut fibers (312).

8 Claims, 7 Drawing Sheets

(56) References Cited

U.S. PATENT DOCUMENTS

| | | | | |
|---|---|---|---|---|
| 6,830,801 | B1 * | 12/2004 | Kenmochi et al. | 428/136 |
| 7,334,287 | B2 * | 2/2008 | Tanaka et al. | 15/229.3 |
| 7,566,671 | B2 | 7/2009 | Hoadley et al. | |
| 8,146,197 | B2 | 4/2012 | Yamada | |
| 2004/0016074 | A1 | 1/2004 | Tanaka | |
| 2005/0092421 | A1 | 5/2005 | Kenmochi et al. | |
| 2006/0185108 | A1 | 8/2006 | Hoadley et al. | |
| 2007/0050934 | A1 | 3/2007 | Yamada | |
| 2007/0190878 | A1 | 8/2007 | Willman et al. | |
| 2008/0148508 | A1 | 6/2008 | Yamada | |
| 2010/0015383 | A1 | 1/2010 | Yamada | |
| 2010/0088837 | A1 | 4/2010 | Wada et al. | |
| 2011/0277258 | A1 | 11/2011 | Otsuka et al. | |

FOREIGN PATENT DOCUMENTS

| | | | |
|---|---|---|---|
| EP | 0 943 425 | A1 | 9/1999 |
| EP | 1 212 972 | A2 | 6/2002 |
| EP | 1 731 076 | A1 | 12/2006 |
| JP | 10-5163 | A | 1/1998 |
| JP | 11-235301 | A | 8/1999 |
| JP | 2000-93373 | A | 4/2000 |
| JP | 2000-245670 | A | 9/2000 |
| JP | 2000-296084 | A | 10/2000 |
| JP | 3107183 | U | 1/2005 |
| JP | 2005-40641 | A | 2/2005 |
| JP | 2005-131422 | A | 5/2005 |
| JP | 3668630 | B2 | 7/2005 |
| JP | 2006-230536 | A | 9/2006 |
| JP | 2007-44270 | A | 2/2007 |
| JP | 2008-289341 | A | 11/2007 |
| JP | D1317543 | | 12/2007 |
| JP | 2008-289867 | A | 12/2008 |
| JP | 2009-6134 | A | 1/2009 |
| JP | 2009-153910 | A | 7/2009 |
| WO | 03/049589 | A1 | 6/2003 |
| WO | 2005/099549 | A1 | 10/2005 |
| WO | WO 2006/070502 | A1 | 7/2006 |
| WO | WO 2008-099733 | A1 | 8/2008 |
| WO | WO 2010/092895 | A1 | 8/2010 |

OTHER PUBLICATIONS

Extended European Search Report issued on Nov. 8, 2010 in corresponding European Patent Application No. 08752134.

International Search Report, PCT/JP2008/058100, Jul. 22, 2008.

International Preliminary Report on Patentability for Application No. PCT/JP2009/057248, dated Nov. 30, 2010.

International Search Report for Application No. PCT/JP2009/057248, dated Jul. 28, 2009.

International Search Report, PCT/JP2010/051573, Mar. 9, 2010.

English Translation of International Preliminary Report on Patentability (Form PCT/IB/373) issued on Sep. 13, 2011 in corresponding International Application PCT/JP2010/051573.

Notification of Transmittal of Translation of the International Preliminary Report on Patentability (Form PCT/IB/338), dated Sep. 22, 2011, issued in corresponding International Application PCT/JP2010/051573.

Written Opinion of the International Searching Authority (Form PCT/ISA/237), dated Mar. 9, 2010, issued in corresponding International Application PCT/JP2010/051573.

Chinese Office Action, dated Jun. 26, 2012, for Chinese Application No. 200980113391.5 with an English translation.

Japanese Office Action, dated Sep. 4, 2012, for Japanese Application No. 2008-106357 with an English translation.

Japanese Office Action, dated Sep. 4, 2012, for Japanese Application No. 2008-152015 with an English translation.

United States Office Action, dated Oct. 17, 2013, for U.S. Appl. No. 12/988,224.

* cited by examiner

CLEANING SHEET

TECHNICAL FIELD

The present invention relates to a cleaning sheet having a multitude of long fibers oriented in substantially one direction.

BACKGROUND ART

There are cleaning sheets that are used by being attached to the head of a cleaning tool which further includes a handle connected to the head. Some types of these cleaning sheets are known to have a multitude of long fibers.

For example, Patent Literature 1 discloses a cleaning sheet having a base sheet and a plurality of fiber bundles joined to the base sheet by respective joining sections and arranged side-by-side to one another.

In the cleaning sheet of Patent Literature 1, however, each joining section is formed substantially in the center of the orientation direction of the fibers constituting each fiber bundle and is formed as a straight line extending in a direction intersecting with the orientation direction of the fibers. This structure limits the degree of freedom between the base sheet and the fiber bundles, and makes it difficult to improve the dirt trapping capabilities of the cleaning sheet. Further, the fiber bundles of the cleaning sheet of Patent Literature 1 are arranged side-by-side independent from one another. In such a structure, the long fibers have no uncut sections between adjacent fiber bundles, and thus, the overall strength of the cleaning sheet is reduced. Further, because there are no uncut long fibers, the voluminosity of the long fibers in the entire cleaning sheet is also reduced.

Patent Literature 2 discloses a cleaning article having a long-fiber layer, consisting of long fibers, provided on a substrate sheet. The long-fiber layer is joined to the substrate sheet by a plurality of joining lines. Between adjacent joining lines, there are cut sections formed by partially cutting the substrate sheet and the long-fiber layer as well as uncut sections.

In the cleaning article of Patent Literature 2, however, the long-fiber layer is joined to the substrate sheet only by these joining lines which are formed extending in a direction intersecting with the orientation direction of the long fibers. Thus, the degree of freedom between the substrate sheet and the long-fiber layer is limited, and it is difficult to improve the dirt trapping capabilities of the cleaning sheet.

Patent Literature 1: JP-A-2007-289341
Patent Literature 2: JP-A-11-235301

SUMMARY OF INVENTION

Accordingly, the present invention relates to a cleaning sheet in which the degree of freedom between the substrate sheet and the long-fiber bundles is not limited by the joining sections and in which the dirt trapping capabilities are thus improved. The invention also relates to a cleaning sheet in which the overall strength of the cleaning sheet and the voluminosity of the long fibers are less prone to deteriorate even when the long fibers are cut.

The invention relates to a cleaning sheet including: a substrate sheet; and a plurality of long-fiber bundles provided on at least one side of the substrate sheet, each long-fiber bundle being made by aggregating long fibers oriented in substantially one direction, the long-fiber bundles being arranged side-by-side and joined to the substrate sheet.

Each long-fiber bundle is formed by joining the long fibers together with a plurality of fiber-joining sections each extending linearly in a direction intersecting with the orientation direction of the long fibers, and each long-fiber bundle is joined to the substrate sheet by a plurality of sheet-joining sections.

Each sheet-joining section is provided so as to overlap a portion of one of the fiber-joining sections. Each long-fiber bundle has been cut by a plurality of linear cut sections.

Each linear cut section is formed in a region between adjacent sheet-joining sections which are adjacent to one another in the orientation direction of the long fibers, and each long-fiber bundle includes cut fibers which are long fibers that have been cut by the linear cut sections and also includes uncut fibers, which have not been cut, in the vicinity of the linear cut sections.

DESCRIPTION OF EMBODIMENTS

A preferred embodiment of a cleaning sheet of the present invention will be described below with reference to FIGS. 1 to 5.

Figure 1:
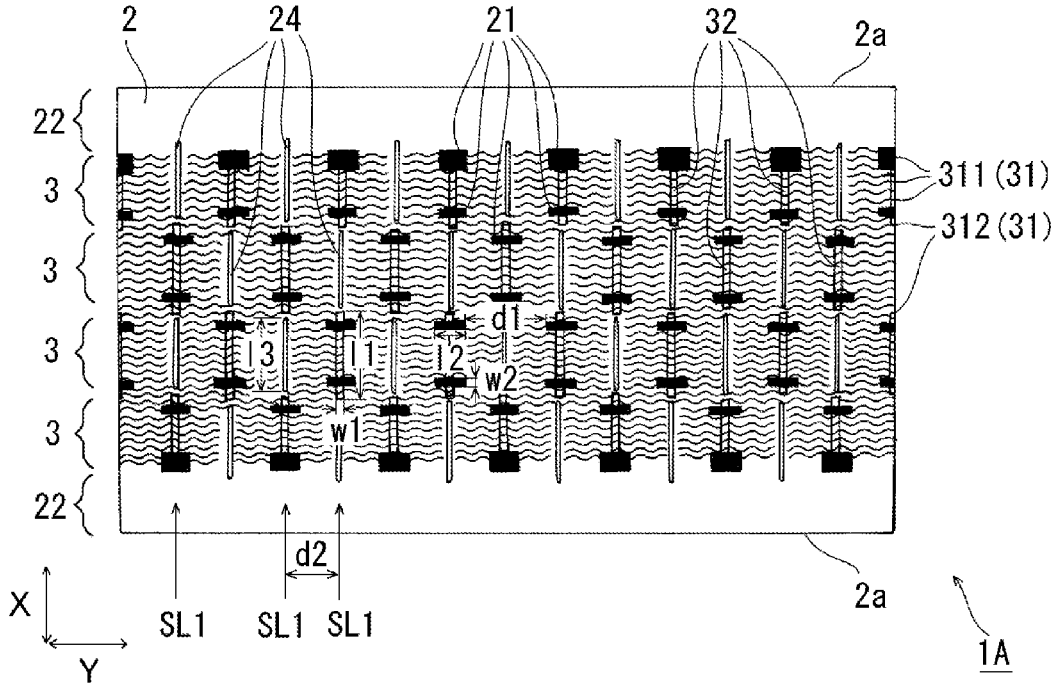
FIG. 1 is a plan view of a cleaning sheet according to a first embodiment of the invention.
Figure 2:
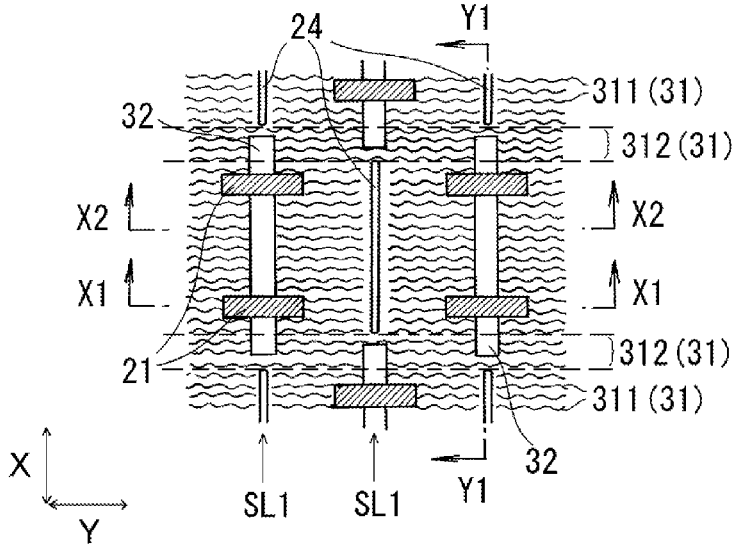
FIG. 2 is an enlarged plan view illustrating a main section of the cleaning sheet illustrated in FIG. 1.
Figure 3:
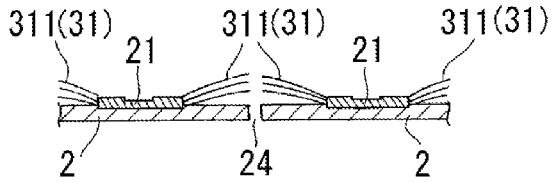
FIG. 3(*a*) is a partial cross-sectional view of the cleaning sheet taken along line X1-X1 of FIG. 2, FIG. 3(*b*) is a partial cross-sectional view of the cleaning sheet taken along line X2-X2 of FIG. 2, and FIG. 3(*c*) is a partial cross-sectional view of the cleaning sheet taken along line Y1-Y1 of FIG. 2.
Figure 3:
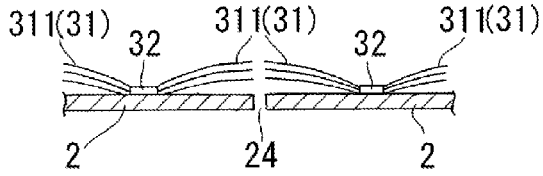
Figure 3:
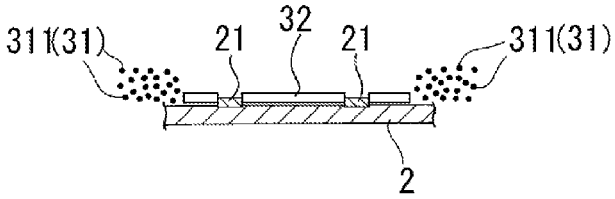

As illustrated in FIGS. 1 to 3, the cleaning sheet 1A of the first embodiment is a cleaning sheet including: a substrate sheet 2; and a plurality of long-fiber bundles 3 provided on both sides of the substrate sheet 2, each long-fiber bundle 3 being made by aggregating long fibers 31 oriented in substantially one direction, the long-fiber bundles 3 being arranged side-by-side and joined to the substrate sheet 2. Note that the long-fiber bundles 3 are arranged in the same manner on both sides of the substrate sheet 2, and therefore, FIGS. 1 to 3 only illustrate one side of the substrate sheet 2 on which the long-fiber bundles 3 have been arranged, and the arrangement on the other side is omitted from illustration. Each long-fiber bundle 3 is formed by joining the long fibers 31 together with a plurality of fiber-joining sections 32 each extending linearly in a direction intersecting with the orientation direction of the long fibers 31. Each long-fiber bundle 3 is joined to the substrate sheet 2 by a plurality of sheet joining sections 21. Each sheet-joining section 21 is provided so as to overlap a portion of one of the fiber-joining sections 32. Each long-fiber bundle 3 has been cut by a plurality of linear cut sections 24, each linear cut section 24 being formed in a region between adjacent sheet joining sections 21, 21 adjacent to one another in the orientation direction of the long fibers 31. Each long-fiber bundle 3 includes cut fibers 311 which are long fibers 31 that have been cut by the linear cut sections 24 and also includes uncut fibers 312, which have not been cut, in the vicinity of the linear cut sections 24.

The cleaning sheet 1A of the first embodiment will be described in detail.

The cleaning sheet preferably has two to thirty long-fiber bundles 3, per side, on both sides of the substrate sheet 2; the present cleaning sheet 1A has four long-fiber bundles 3 which are arranged side-by-side and joined to the substrate sheet. The first embodiment has the long-fiber bundles 3 on both sides of the substrate sheet 2, but the long-fiber bundles may be provided on only one side thereof.

Below, a cleaning sheet 1A having four long-fiber bundles 3, per side, on both sides of the substrate sheet 2 will be described in detail with reference to the drawings.

As illustrated in FIG. 1, the substrate sheet 2 is rectangular. The length of the substrate sheet 2 is preferably 10 cm to 60 cm, and the width of the substrate sheet 2 is preferably 5 cm to 40 cm. In the cleaning sheet 1A of the first embodiment, the substrate sheet 2 is arranged such that the length direction of the substrate sheet 2 coincides with the orientation direction of the long fibers 31, as illustrated in FIG. 1. The orientation direction of the long fibers 31 and the length direction of the substrate sheet 2 coincide with the Y direction in the figure; the direction orthogonal to the orientation direction of the long fibers 31 and the width direction of the substrate sheet 2 coincide with the X direction in the figure. In the cleaning sheet 1A, four long-fiber bundles 3 are disposed on each side of the substrate sheet 2 by sheet-joining sections 21.

Generally, the long fibers 31 that constitute the long-fiber bundle 3 are oriented in a direction in which the material therefor is carried during production.

Herein, the expression "the long fibers 31 are oriented in substantially one direction" does not intend to exclude instances where the orientation direction of some of the long fibers 31 deviates from the orientation direction of the rest of the majority of the long fibers 31 due to manufacturing error, crimping of the long fibers 31, and so forth.

As illustrated in FIGS. 1 and 2, in the cleaning sheet 1A of the first embodiment, each long-fiber bundle 3 is formed by joining the multitude of long fibers 31 together with a plurality of fiber-joining sections 32 extending linearly in a direction (X direction) orthogonal to the orientation direction of the long fibers 31. The long-fiber bundle 3 is a bundle of fibers to be disposed on the substrate sheet 2 spanning the opposite ends in the length direction of the substrate sheet 2 (Y direction) and is composed of uncut fibers 312 that are arranged along the orientation direction of the long fibers 31 (Y direction) and that have not been cut by linear cut sections 24 (described further below); and fibers that are arranged along the orientation direction of the long fibers 31 (Y direction) and joined by the fiber-joining sections 32. As illustrated in FIG. 1, each long-fiber bundle 3 is rectangular which is long in the orientation direction of the long fibers 31 (Y direction), as viewed macroscopically.

As illustrated in FIG. 1, in the cleaning sheet 1A of the first embodiment, the long-fiber bundles 3 are disposed on both sides of the substrate sheet 2 such that the length direction of each long-fiber bundle 3 matches the length direction of the substrate sheet 2 (Y direction). Further, as illustrated in FIG. 1, in the cleaning sheet 1A of the first embodiment, four long-fiber bundles 3 are disposed side-by-side in the orthogonal direction (X direction) to the orientation direction of the long fibers 31—i.e., in the width direction of the substrate sheet 2—without leaving substantially any space therebetween. When placed on the substrate sheet 2, the length of each long-fiber bundle 3 is substantially the same as the length of the substrate sheet 2, and the width of each long-fiber bundle 3 is substantially the same as the length (l1) of the fiber-joining section 32 described below. Note, however, that in cases where the fiber-joining sections 32 adjacent to one another in the orthogonal direction (X direction) to the orientation direction of the long fibers 31 are connected or otherwise linked and it is difficult to determine the length (l1) of each fiber-joining section 32, then the width of each long-fiber bundle 3 is defined as a length between two points, each of which being located at substantially the center of a distance between linear cut sections 24 (described further below) located adjacent to one another in the orthogonal direction (X direction) to the orientation direction of the long fibers 31. The width of each long-fiber bundle 3 determined as above is preferably 1 cm to 15 cm. As illustrated in FIG. 1, in the cleaning sheet 1A, the width of the substrate sheet 2 is larger than the total width of the four long-fiber bundles 3, and the regions of the substrate sheet 2 located outward widthwise (X-direction-wise) of the long-fiber bundles 3 (which are referred to hereinafter as "flaps 22") become sections that are used to attach the cleaning sheet to a head of a cleaning tool (described in detail further below).

The number of long fibers 31 constituting each long-fiber bundle 3 is preferably 1,000 to 50,000 pieces, and more preferably 5,000 to 40,000 pieces, per centimeter of the fiber-joining section 32 on one side thereof from the standpoint of dust trapping capabilities.

The long fibers 31 constituting the long-fiber bundle 3 are used in the form of a fiber aggregate (tow). It is preferable to sufficiently open the fiber aggregate (tow) with a known opening device beforehand. While the thickness of the long fibers 31 is not particularly critical, the thickness is preferably 0.1 to 200 dtex, and more preferably 2 to 30 dtex, from the standpoint of ensuring dust trapping capabilities and preventing scratches on the surface of an object-being-cleaned. It is also preferable to use crimped fibers as the long fibers 31 because the dust trapping capabilities can be further improved. Also, colors other than white (such as orange or light blue) may be used for the long fibers 31 in order, for example, to improve the product appearance and visibility of any soil attached.

The fiber-joining sections 32 are for forming the long-fiber bundle 3 and are not for joining the long-fiber bundle 3 to the substrate sheet 2. Each fiber-joining section 32 is formed by heat-fusion or with a hot-melt adhesive, and in the cleaning sheet 1A, it is formed by heat-fusing the long fibers 31. As illustrated in FIGS. 1 to 3, the fiber-joining sections 32 are formed extending linearly in the orthogonal direction (X direction) to the orientation direction of the long fibers 31, i.e., in the width direction of the substrate sheet 2. The length l1 of each fiber-joining section 32, as illustrated in FIG. 1, is preferably 5 mm to 150 mm. The width w1 of each fiber-joining section 32, as illustrated in FIG. 1, is preferably 0.5 mm to 10 mm.

The sheet-joining sections 21 are for joining the long-fiber bundles 3 to the substrate sheet 2, and are formed by heat-fusion or with a hot-melt adhesive; in the cleaning sheet 1A, they are formed by heat-fusing the long fibers 31 to the substrate sheet 2. Each sheet-joining section 21 is provided so as to overlap a portion of one of the fiber-joining sections 32. It is preferable to provide one to sixteen sheet-joining sections 21 for each fiber joining section 32; in the cleaning sheet 1A, two sheet-joining sections 21 are provided per fiber-joining section 32. As illustrated in FIGS. 1 to 3, each sheet-joining section 21 is formed on the fiber joining section 32, and in the cleaning sheet 1A, the dimension of the sheet-joining section 21 is formed to be long in the orientation direction of the long fibers 31 (Y direction). The two sheet-joining sections 21 provided on a certain fiber-joining section 32 are located at substantially the same positions, in terms of the orientation direction of the long fibers 31 (Y direction), as the two sheet joining sections 21 provided on a fiber-joining section 32 adjacent to the certain fiber-joining section in the orientation direction of the long fibers 31.

The length l2 of each sheet joining section 21, as illustrated in FIG. 1, is preferably 2 mm to 50 mm in the orientation direction of the long fibers 31 (Y direction). The width w2 of each sheet-joining section 21, as illustrated in FIG. 1, is preferably 0.5 mm to 10 mm In the cleaning sheet 1A, the distance d1 between sheet-joining sections 21 adjacent to one another in the orientation direction of the long fibers 31 (Y direction) is preferably 6 mm to 200 mm.

In the cleaning sheet 1A, the long-fiber bundles 3 are joined to the substrate sheet 2 by the sheet-joining sections 21 whose length (l2) is shorter than the length (l1) of the fiber-joining sections 32, as illustrated in FIG. 3(*a*) and FIG. 3(*c*). At sites where the sheet-joining sections 21 are not provided in areas between the fiber-joining sections 32 adjacent to one another in the orientation direction of the long fibers 31 (Y direction), the long-fiber bundles 3 are not joined to the substrate sheet 2 and are separate from the substrate sheet 2, as illustrated in FIG. 3(*b*). The fiber-joining sections 32 are joined to the substrate sheet 2 only at portions where the sheet-joining sections 21 overlap the fiber-joining sections 32 as illustrated in FIG. 3(*c*), and in the rest of the portions (where there is no sheet-joining section 21 overlapping the fiber-joining sections 32), the long-fiber bundles 3 are not joined to the substrate sheet 2 and the long-fiber bundles 3 are separate from the substrate sheet 2.

Each of the four long-fiber bundles 3 has been cut by a plurality of linear cut sections 24. As a result, each long-fiber bundle 3 includes cut fibers 311 which are long fibers 31 that have been cut by the linear cut sections 24 and also includes uncut fibers 312, which have not been cut, in the vicinities of the opposite ends of the linear cut sections 24, as illustrated in FIG. 2. The uncut fibers are not joined to the substrate sheet, and thanks to these uncut fibers 312, the areas between the fiber-joining sections 32 adjacent to one another in the orientation direction of the long fibers 31 (Y direction) do not become separate, and the long-fiber bundle 3 can retain its bundled state. Preferably, two to forty linear cut sections 24 are provided per long-fiber bundle 3; in the present cleaning sheet 1A, six or seven linear cut sections 24 are provided per long-fiber bundle 3. Each linear cut section 24 is formed in a region between adjacent sheet-joining sections 21 and 21 which are adjacent to one another in the orientation direction of the long fibers 31 (Y direction). Further, in the cleaning sheet 1A, the substrate sheet 2 is cut by the linear cut sections 24 at the same positions as where the long-fiber bundles 3 have been cut.

As illustrated in FIG. 1, the length l3 of each linear cut section 24 is preferably longer than the width w2 of the sheet-joining section 21 from the standpoint of forming the cut fibers 311 by reliably performing cutting in the region between adjacent sheet-joining sections 21, 21 adjacent to one another in the orientation direction of the long fibers 31 (Y direction), and is preferably equal to or shorter than the length l1 of the fiber-joining section 32 from the standpoint of forming the uncut fibers 312 in the long-fiber bundles 3. More specifically, the length l3 of each linear cut section 24, in the orthogonal direction (X direction) to the orientation direction of the long fibers 31, is preferably 3 mm to 140 mm, more preferably 8 mm to 70 mm. Note that in the present cleaning sheet 1A, the length of the linear cut section 24 is substantially the same as the length of the fiber-joining section 32.

As illustrated in FIGS. 1 and 2, in the cleaning sheet 1A, the fiber-joining sections 32 and the linear cut sections 24 in the four long-fiber bundles 3 are arranged alternately in the orthogonal direction (X direction) to the orientation direction of the long fibers so as to form a plurality of continuous straight lines SL1 extending along said direction. Preferably, there are two to forty straight lines SL1 in the orientation direction of the long fibers 31; in the present cleaning sheet 1A, there are thirteen straight lines SL1. Further, in the cleaning sheet 1A, the fiber-joining sections 32 and the linear cut sections 24 are arranged alternately in the orientation direction of the long fibers 31 (Y direction), as illustrated in FIGS. 1 and 2. The distance d2 between adjacent straight lines SL1 adjacent to one another in the orientation direction of the long fibers 31 (Y direction) is substantially the same in all sections as illustrated in FIG. 1, and is preferably 5 mm to 150 mm. Note that the distance d2 is a value measured between two fiber-joining sections 32 adjacent to one another in the orientation direction of the long fibers 31 (Y direction).

The fiber length of the cut fibers 311 in the long-fiber bundle 3 is preferably 5 to 150 mm, more preferably 10 to 120 mm, from the standpoint of dust trapping capabilities. The fiber length of the cut fiber 311 is the length from the fiber-joining section 32 to the tip ends of the long fibers 31.

Figure 4:
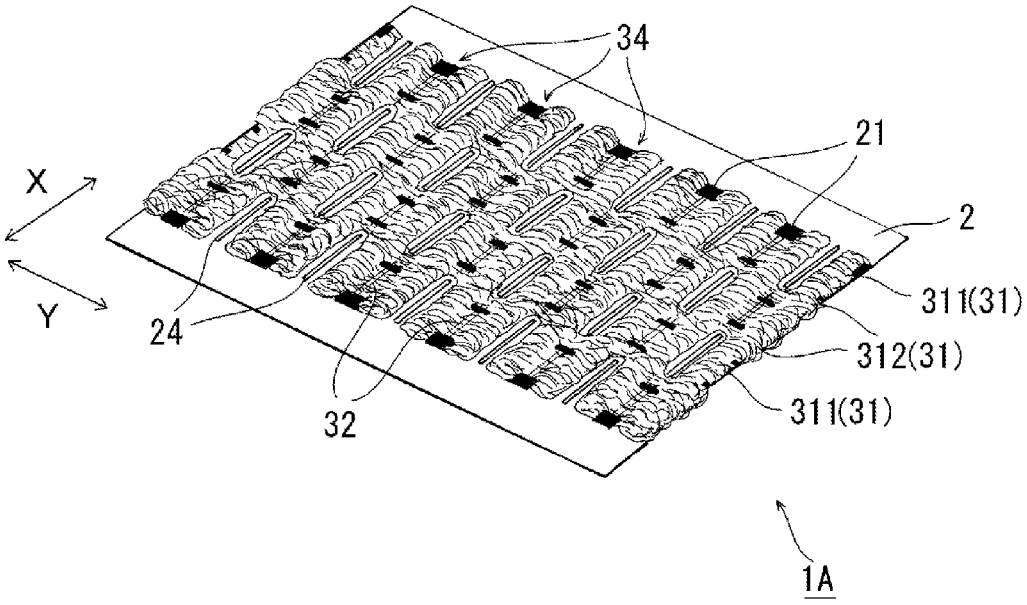
FIG. 4 is a perspective of the cleaning sheet illustrated in FIG. 1 after it has been opened three-dimensionally.

By three-dimensionally opening the cut fibers 311 consisting of the long fibers 31, the multitude of cut fibers 311 rise up from the substrate sheet 2, with the sheet-joining sections 21 and the fiber-joining sections 32 serving as the base points, and become entangled with one another. In the cleaning sheet 1A, due to the three-dimensional opening, a plurality of spherical fiber balls 34 are formed as a result of the cut fibers 311 becoming entangled around each fiber-joining section 32, as illustrated in FIG. 4. In the cleaning sheet 1A, the plurality of spherical fiber balls 34 are arranged in a staggered pattern, as illustrated in FIG. 4, and these fiber balls 34 are connected with one another by the uncut fibers 312 that are located in the vicinities of the opposite ends of the linear cut sections 24 and extend linearly along the length direction of the substrate sheet 2 (Y direction). More specifically, as illustrated in FIG. 4, the cleaning sheet 1A has the substrate sheet 2, and a plurality of fiber balls 34 on both sides of the substrate sheet 2, each fiber ball 34 having a fiber-joining section 32 that extends linearly along the direction (X direction) intersecting with the orientation direction of the long fibers 31. As illustrated in FIG. 4, the cleaning sheet 1A has rows of fiber balls 34, each row having several fiber balls 34 arranged along the length direction of the substrate sheet 2 (Y direction), and several rows of fiber balls 34 are formed on the substrate sheet 2 in the width direction thereof (X direction). The fiber balls 34 are joined to the substrate sheet 2 by the sheet-joining sections 21 which are provided overlapping the fiber-joining sections 32 and which are long in the orientation direction of the long fibers 31 (Y direction). The cleaning sheet 1A has the uncut fibers 312 between adjacent rows of fiber balls 34.

Next, the materials for forming the cleaning sheet 1A of the first embodiment will be described.

Fibrous sheets such as nonwoven fabrics used for conventional cleaning sheets may be used for the substrate sheet 2. Air-through nonwoven fabrics or spun-bonded nonwoven fabrics, which are flexible in the length direction (Y direction), are particularly preferable to make the sheet easily conform to the contour of an object-being-cleaned. Further, other nonwoven fabrics, netted sheets, films, synthetic paper, or composite materials made thereof may be used as the material for forming the substrate sheet 2.

The long fibers 31 may be made using such materials as heat-fusible synthetic fibers, conjugate fibers, or crimped fibers produced by heat-treating the above. The long fibers 31 may be provided with dust adsorbents and/or may undergo such treatments as oil-solution impregnation, anti-static treatment, electrical-charging treatment, and hydrophilizing treatment, as necessary.

It is preferable that both the substrate sheet 2 and the long fibers 31 contain heat-fusible materials from the standpoint of ease in forming the fiber-joining sections 32 and the sheet-joining sections 21 through heat fusion.

The actions and effects of the above-described cleaning sheet 1A of the first embodiment of the present invention, when in use, will be described below.

Figure 5:
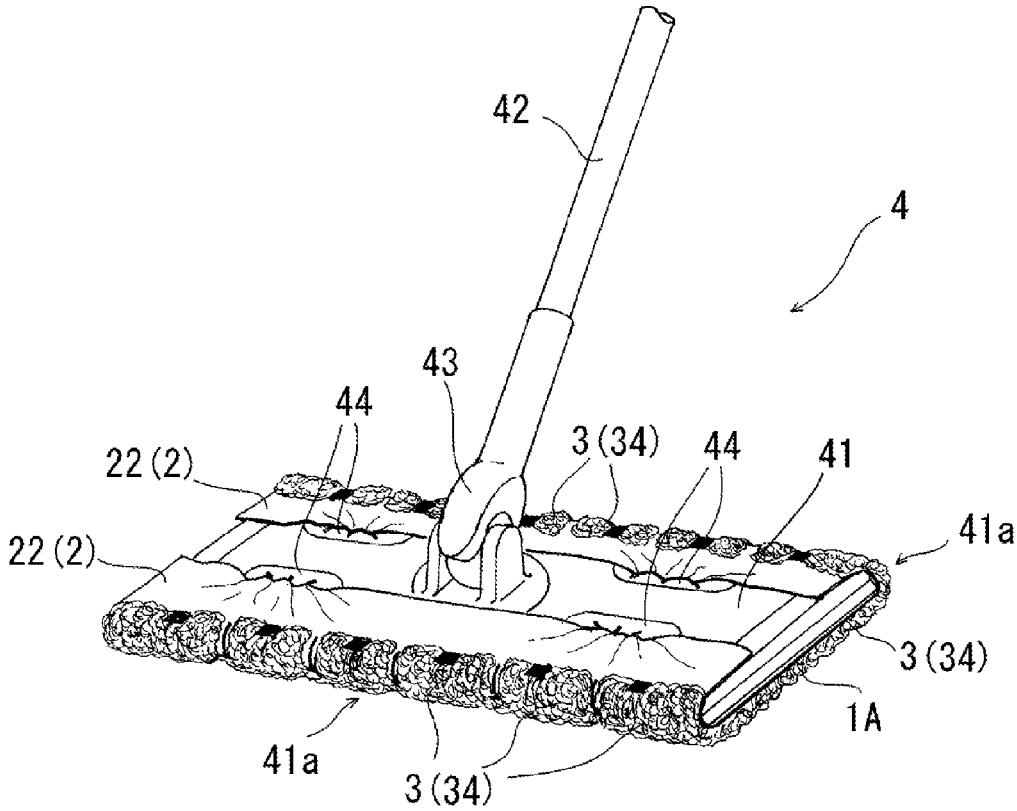
FIG. 5 is a perspective illustrating the cleaning sheet of FIG. 1 attached to a cleaning tool.

As illustrated in FIG. 5, the cleaning sheet 1A of the first embodiment is used on a cleaning tool 4 that has a head 41 and a handle 42 connected to the head 41, with the substrate sheet 2 being utilized to attach the cleaning sheet 1A to the head 41.

The cleaning tool 4 illustrated in FIG. 5 includes a head 41 to which the cleaning sheet 1A of the present embodiment can be attached, and a rod-like handle 42 connected to the head 41 via a universal joint 43. The attachment surface (bottom surface) of the head 41 is rectangular as viewed from above. Normally, the cleaning tool 4 is used to perform cleaning by moving (particularly back and forth) the head 41 in its width direction. In other words, the cleaning direction of the cleaning tool 4 is in the width direction of the head 41.

In the cleaning sheet 1A of the first embodiment, the total area of the four long-fiber bundles 3 is wider than the bottom surface area of the head 41 of the cleaning tool 4 to which the cleaning sheet 1A is to be attached. In the cleaning sheet 1A of the first embodiment, the orientation direction of the long fibers 31 (Y direction), the length direction of the substrate sheet 2, and the length direction of the head 41 of the cleaning tool 4 coincide with one another, and the cleaning sheet 1A is attached to the attachment surface (bottom surface) of the head 41 by matching the central point of the substrate sheet 2 with the central point of the head 41. Then, the flaps 22, 22 of the substrate sheet 2 are folded back toward the upper surface of the head 41. In doing so, the cleaning sheet 1A is attached such that the long-fiber bundles 3 exist also on side surfaces 41*a* of the head 41 extending along the length direction thereof, as illustrated in FIG. 5. The flaps 22 are then pressed into a plurality of flexible sheet retainers 44 provided in the head 41, each having slits in a radial pattern. In this way, the cleaning sheet 1A can be fixed to the head 41 of the cleaning tool 4. Note that it is preferable to form the substrate sheet 2 out of a netted sheet because of the good engagement between the substrate sheet 2 and the sheet retainers 44. The cleaning sheet 1A of the present embodiment can be used in this state for sweeping wooden floors, for example. Accordingly, the orthogonal direction (X direction) to the orientation direction of the long fibers 31 in the long-fiber bundles 3, which matches the width direction of the substrate sheet 2, is oriented substantially in the cleaning direction of the cleaning tool 4.

When attached to the head 41 of a cleaning tool 4, the cleaning sheet 1A of the first embodiment can be used for cleaning, such as sweeping (mopping) wooden-floored rooms, in the same way as ordinary mopping tools.

As illustrated in FIGS. 1 and 2, in the cleaning sheet 1A of the first embodiment, the fiber-joining sections 32 for forming the long-fiber bundles 3 are provided separately from the sheet-joining sections 21 for joining the long-fiber bundles 3 to the substrate sheet 2. Further, as illustrated in FIG. 3(*b*), in the present cleaning sheet 1A, the long-fiber bundles 3 and the substrate sheet 2 are not joined together—and are thus separate from one another—between adjacent fiber-joining sections 32, 32 in wide regions other than those portions overlapping with the sheet-joining sections 21, and therefore, the long-fiber bundles 3 are not restrained by the sheet joining sections 21 in those regions. In other words, the degree of freedom of the long fibers 31 which constitute the long-fiber bundles 3 is not limited by the sheet-joining sections 21 in regions between adjacent sheet-joining sections 21, 21, and thus the dirt trapping capabilities of the cleaning sheet 1A is improved.

Further, as illustrated in FIGS. 1 and 2, the cleaning sheet 1A of the first embodiment has uncut fibers 312, which are long fibers 31 that have not been cut by the linear cut sections 24. The uncut fibers are not joined to the substrate sheet 2, and thanks to these uncut fibers 312, the long-fiber bundle 3 can retain its bundled state. More specifically, the spherical fiber balls 34 formed around each fiber-joining section 32 by three-dimensional opening as illustrated in FIG. 4 are not completely independent but are connected with one another. Therefore, the overall strength of the cleaning sheet 1A and the voluminosity of the long fibers 31 are less prone to deteriorate even when the long fibers are cut by the linear cut sections 24. Thus, the dirt trapping capabilities can be kept high.

Further, as illustrated in FIGS. 1 and 2, in the cleaning sheet 1A of the first embodiment, each sheet-joining section 21 is made long in the orientation direction of the long fibers 31 (Y direction). Such a structure prevents the long fibers 31 from getting tangled and thus improves the dirt trapping capabilities of the cleaning sheet 1A.

Further, in the cleaning sheet 1A of the first embodiment, the substrate sheet 2 is cut by the linear cut sections 24 at the same positions as where the long-fiber bundles 3 have been cut, as illustrated in FIG. 3(*a*). Therefore, the substrate sheet 2 is flexible in the length direction (Y direction). Thus, the cleaning sheet 1A having this substrate sheet 2, which has been cut accordingly, can easily conform to the surface-to-be-cleaned, thus further improving the effect of trapping dirt, etc.

Furthermore, in the cleaning sheet 1A of the first embodiment, the total area of the four long-fiber bundles 3 is wider than the bottom surface area of the head 41 of the cleaning tool 4 to which the cleaning sheet 1A is to be attached, as illustrated in FIG. 5. Therefore, when the cleaning sheet 1A is attached to the head 41 of the cleaning tool 4, the long-fiber bundles 3 exist also on the side surfaces along the length direction of the head 41. Thus, dirt and dust that have built up at corners of floors etc. can also be trapped effectively.

Next, a cleaning sheet according to a second embodiment of the present invention will be described with reference to FIGS. 6 and 7.

As for the cleaning sheet 1B of the second embodiment, only the differences from the cleaning sheet 1A of the first embodiment will be described below. Matters that are not particularly described are the same as in the cleaning sheet 1A of the first embodiment, and the descriptions for the cleaning sheet 1A of the first embodiment apply as appropriate thereto.

Figure 6:
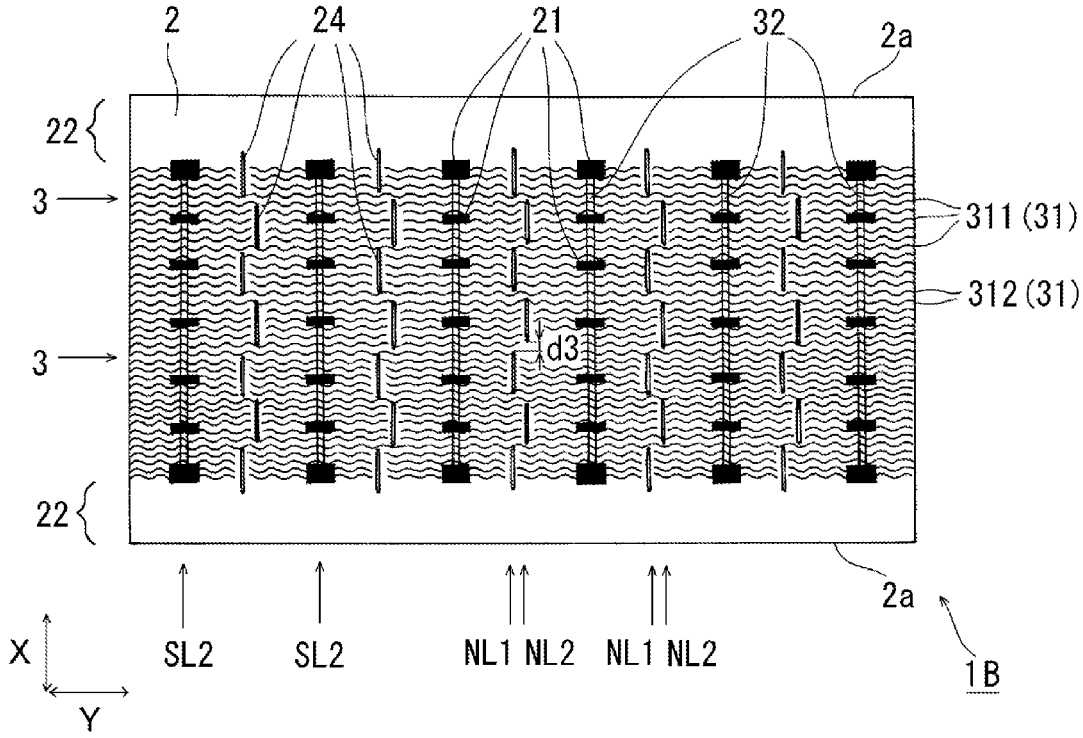
FIG. 6 is a plan view of a cleaning sheet according to a second embodiment of the invention.
Figure 7:
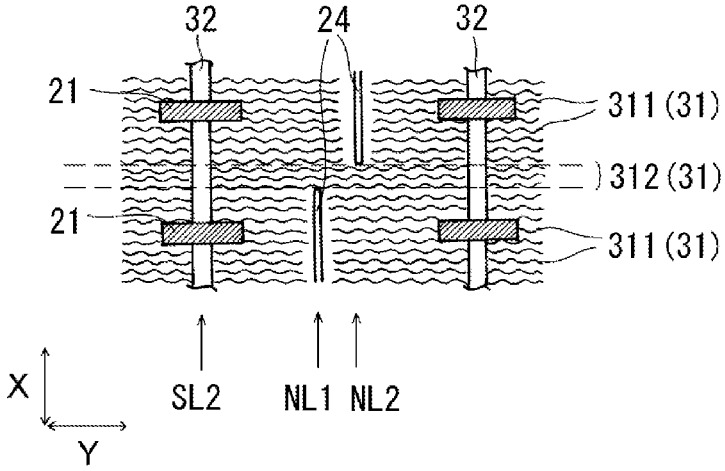
FIG. 7 is an enlarged plan view illustrating a main section of the cleaning sheet illustrated in FIG. 6.

In the present cleaning sheet 1B, the fiber-joining sections 32 in the long-fiber bundles 3 are arranged so as to form a plurality of continuous straight lines SL2 extending in the orthogonal direction (X direction) to the orientation direction of the long fibers 31, as illustrated in FIGS. 6 and 7. More specifically, each straight line SL2 is formed by connecting the fiber-joining sections 32 provided in the respective long-fiber bundles 3 adjacent to one another in the orthogonal direction (X direction) to the orientation direction of the long fibers 31, and extends in the orthogonal direction (X direction) to the orientation direction of the long fibers 31. Preferably, two to thirty straight lines SL2 are formed in the orientation direction of the long fibers 31 (Y direction); in the present cleaning sheet 1B, there are six straight lines SL2. As described above for the cleaning sheet 1A, the length of each long-fiber bundle 3 is substantially the same as the length of the substrate sheet 2; and the width of each long-fiber bundle 3, in cases where it is difficult to determine the length (l1) of each fiber-joining section 32, is defined as a length between two points, each of which being located at substantially the center of a distance between two linear cut sections 24 located adjacent to one another in the direction orthogonal to the orientation direction of the long fibers 31. So, the present cleaning sheet 1B has seven long-fiber bundles 3, as illustrated in FIG. 6.

In the cleaning sheet 1B, the linear cut sections 24 in the long-fiber bundles 3 are arranged so as to form discontinuous straight lines in the orthogonal direction (X direction) to the orientation direction of the long fibers 31, as illustrated in FIGS. 6 and 7. In the cleaning sheet 1B, the fiber-joining sections 32 and the linear cut sections 24 are arranged alternately in the orientation direction of the long fibers 31 (Y direction), as illustrated in FIGS. 6 and 7. More specifically, the linear cut sections 24 are formed in regions between sheet-joining sections 21, 21 provided on adjacent fiber-joining sections 32, 32 which are adjacent to one another in the orientation direction of the long fibers 31 (Y direction), as illustrated in FIGS. 6 and 7. In substantially the center between adjacent fiber-joining sections 32, 32, the linear cut sections 24 in the long-fiber bundles 3 are formed as two parallel discontinuous lines (in a staggered pattern) in the orthogonal direction (X direction) to the orientation direction of the long fibers 31.

As illustrated in FIGS. 6 and 7, in the cleaning sheet 1B, the linear cut sections 24 form two parallel discontinuous straight lines NL1 and NL2, which are discontinuous and linear. The distance d3, in the orthogonal direction (X direction) to the orientation direction of the long fibers 31, between one end of a linear cut section 24 constituting the discontinuous straight line NL1 and one end of a linear cut section 24 constituting the adjacent discontinuous straight line NL2, as illustrated in FIG. 6, is preferably −5 mm to 10 mm, more preferably 0 mm to 5 mm, from the standpoint of forming uncut fibers 312 in the long-fiber bundles 3. Note that the distance d3 with a negative value means that the aforementioned two ends overlap one another.

In the cleaning sheet 1B, due to three-dimensional opening, the cut fibers 311 become entangled to form fiber balls 34 which are formed on the six straight lines SL2 consisting of the fiber-joining sections 32 and which extend along the width direction of the cleaning sheet 1B (X direction). In the cleaning sheet 1B, six fiber balls 34, which extend along the width direction of the cleaning sheet 1B, are arranged side-by-side in the length direction of the cleaning sheet 1B, and these six fiber balls 34 are connected with one another by uncut fibers 312 that are located in the vicinities of the opposite ends of the linear cut sections 24 and extend linearly along the length direction of the substrate sheet 2 (Y direction).

The actions and effects of the above-described cleaning sheet 1B of the second embodiment of the present invention, when in use, will be described below.

The cleaning sheet 113 of the second embodiment, when attached to the head 41 of a cleaning tool 4, can be used for cleaning, such as sweeping (mopping) wooden-floored rooms, in the same way as ordinary mopping tools.

The cleaning sheet 1B of the second embodiment can achieve the same effects as those of the cleaning sheet 1A of the first embodiment. Effects that are different from those of the cleaning sheet 1A of the first embodiment will be described below.

In the cleaning sheet 1B of the second embodiment, the fiber-joining sections 32 are provided on the straight lines SL2, and the linear cut sections 24 are formed in a staggered pattern in each region between straight lines SL2 adjacent to one another in the orientation direction of the long fibers 31 (Y direction). Thus, the length of each linear cut section 24 can be made short, and this allows the rigidity of the substrate sheet 2, i.e., the rigidity of the cleaning sheet 1B, to be kept high, thus facilitating the attachment of the cleaning sheet 1B to the head 41 of the cleaning tool 4. Further, spaces will be formed between the cut fibers 311 within the region of the cleaning sheet 1B, and thus, the long-fiber bundles 3 will have ridges as viewed from above. With this structure, large pieces of dirt can easily enter into the space formed between the fibers 311 and to the inside toward the attachment surface (bottom surface) of the head 41 along the cleaning direction of the cleaning tool 4, thus improving the dirt trapping capabilities.

Next, a cleaning sheet according to a third embodiment of the present invention will be described with reference to FIGS. 8 and 9.

As for the cleaning sheet 1C of the third embodiment, the differences from the cleaning sheet 1A of the first embodiment will be described below. Matters that are not particularly described are the same as in the cleaning sheet 1A of the first embodiment, and the descriptions for the cleaning sheet 1A of the first embodiment apply as appropriate thereto.

Figure 8:
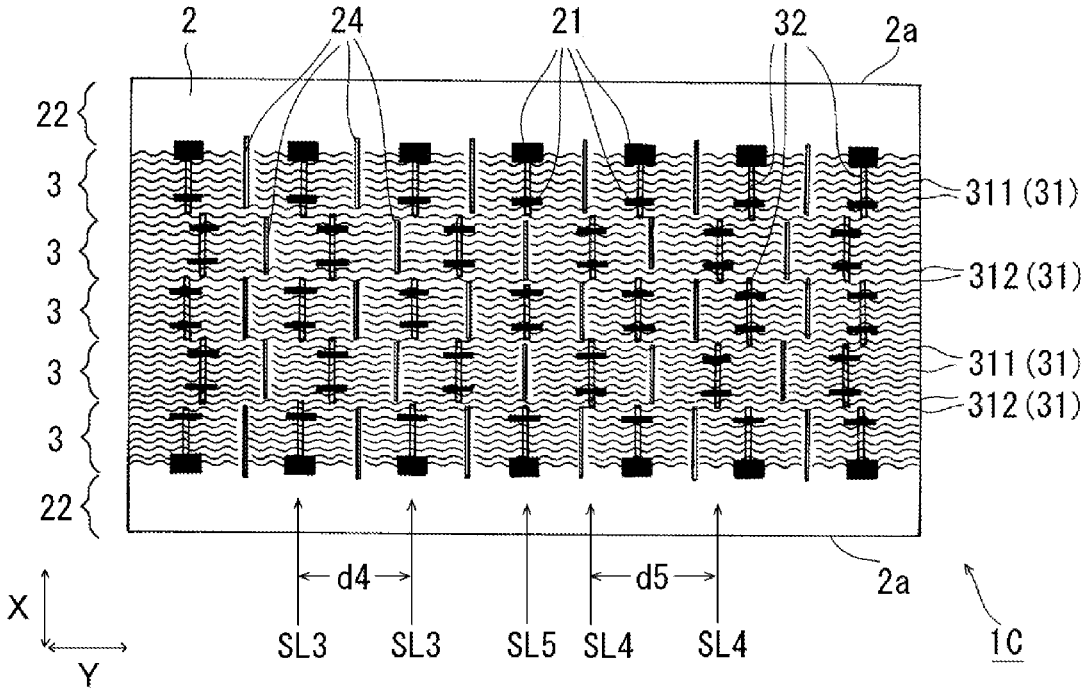
FIG. 8 is a plan view of a cleaning sheet according to a third embodiment of the invention.
Figure 9:
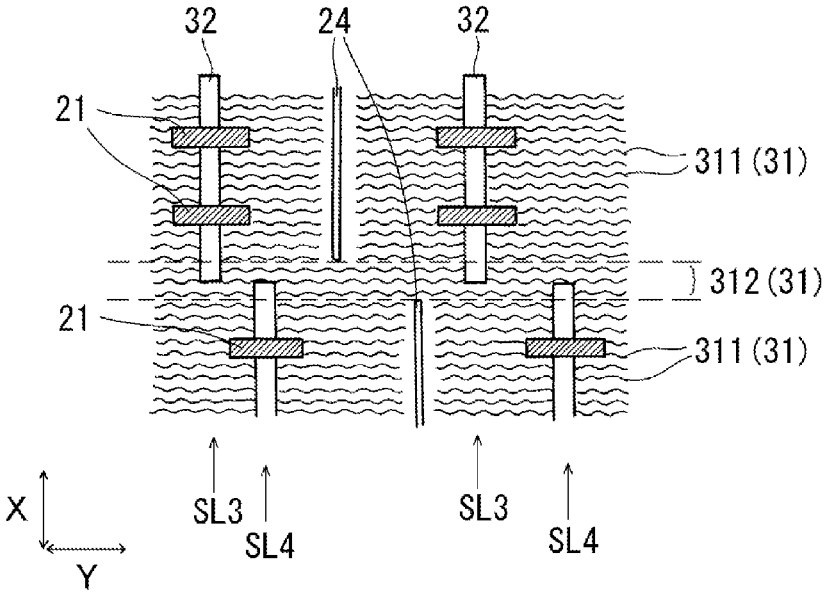
FIG. 9 is an enlarged plan view illustrating a main section of the cleaning sheet illustrated in FIG. 8.

As illustrated in FIGS. 8 and 9, the cleaning sheet of the third embodiment has the long-fiber bundles 3 on both sides of the substrate sheet 2, and preferably at least three, odd number of long-fiber bundles 3 per side. In the illustrated cleaning sheet 1C, there are five long-fiber bundles 3, and these five long-fiber bundles 3 are arranged side-by-side and joined to the substrate sheet. In the cleaning sheet of the third embodiment, the fiber-joining sections 32 in odd-numbered long-fiber bundles 3, as counted from a side edge 2*a* of the substrate sheet 2 extending along the length direction thereof (Y direction), are provided on a plurality of first imaginary straight lines SL3 which are parallel to the direction intersecting with the orientation direction of the long fibers 31 (Y direction). Preferably, two to forty first imaginary straight lines SL3 are formed in the orientation direction of the long fibers 31, and the first imaginary straight lines SL3 adjacent to one another in the orientation direction of the long fibers 31 (Y direction) are formed at substantially even distances. In the cleaning sheet 1C illustrated in FIGS. 8 and 9, the fiber-joining sections 32 in the first, third, and fifth long-fiber bundles 3—as counted from the side edge 2*a* of the substrate sheet 2 extending along the length direction thereof (Y direction)—are provided on the first imaginary straight lines SL3 which are parallel to the orthogonal direction (X direction) to the orientation direction of the long fibers 31. Seven first imaginary straight lines SL3 are provided at substantially even distances in the orientation direction of the long fibers 31 (Y direction).

Further, as illustrated in FIGS. 8 and 9, in the cleaning sheet of the third embodiment, the fiber-joining sections 32 in even-numbered long-fiber bundles 3, as counted from the side edge 2*a* of the substrate sheet 2 extending along the length direction thereof (Y direction), are provided on a plurality of second imaginary straight lines SL4 which are parallel to the direction intersecting with the orientation direction of the long fibers 31 (Y direction). Preferably, two to forty second imaginary straight lines SL4 are formed in the orientation direction of the long fibers 31 (Y direction), and the second imaginary straight lines SL4 adjacent to one another in the orientation direction of the long fibers 31 (Y direction) are formed at substantially even distances. In the cleaning sheet 1C illustrated in FIGS. 8 and 9, the fiber-joining sections 32 in the second and fourth long-fiber bundles 3—as counted from the side edge 2*a* of the substrate sheet 2 extending along the length direction thereof (Y direction)—are provided on the second imaginary straight lines SL4 which are parallel to the orthogonal direction (X direction) to the orientation direction of the long fibers 31. Six second imaginary straight lines SL4 are provided at substantially even distances in the orientation direction of the long fibers 31 (Y direction).

In the cleaning sheet 1C, the distance d4 between the first imaginary straight lines SL3, SL3 adjacent to one another in the orientation direction of the long fibers 31 (Y direction) is made shorter than the distance d5 between the second imaginary straight lines SL4, SL4 adjacent to one another in the orientation direction of the long fibers 31 (Y direction), as illustrated in FIGS. 8 and 9. In the cleaning sheet 1C illustrated in FIGS. 8 and 9, the distance d4 between the first imaginary straight lines SL3, SL3 adjacent to one another in the orientation direction of the long fibers 31 (Y direction) is preferably 5 mm to 150 mm, and the distance d5 between the second imaginary straight lines SL4, SL4 adjacent to one another in the orientation direction of the long fibers 31 (Y direction) is preferably 10 mm to 120 mm.

In the cleaning sheet 1C, the fiber-joining sections 32 and the linear cut sections 24 are arranged alternately in the orientation direction of the long fibers 31 (Y direction), as illustrated in FIGS. 8 and 9. In each of the five long-fiber bundles 3 provided on the cleaning sheet 1C, a linear cut sections 24 is formed at substantially the center between two fiber-joining sections 32 adjacent to one another in the orientation direction of the long fibers 31 (Y direction), as illustrated in FIGS. 8 and 9. Further, in the cleaning sheet 1C as illustrated in FIGS. 8 and 9, the fiber-joining sections 32 and the linear cut sections 24 that are located in the center of the cleaning sheet 1C in the length direction thereof (Y direction) are connected together to form a continuous straight line SL5 which extends along the orthogonal direction (X direction) to the orientation direction of the long fibers 31. As illustrated in FIG. 8, the straight line SL5 is formed on the center line which divides the length of the cleaning sheet 1C into two, and is a straight line extending in the orthogonal direction (X direction) to the orientation direction of the long fibers 31 and formed by connecting the fiber-joining section 32 of the first long-fiber bundle 3 and the fiber-joining section 32 of the third long-fiber bundle 3 with a linear cut section 24 and connecting the fiber-joining section 32 of the third long-fiber bundle 3 and the fiber-joining section 32 of the fifth long-fiber bundle 3 with a linear cut section 24.

In the cleaning sheet 1C, the distance d4 between the first imaginary straight lines SL3, SL3 is made shorter than the distance d5 between the second imaginary straight lines SL4, SL4, and a straight line SL5 consisting of fiber-joining sections 32 and linear cut sections 24 is formed in the center of the cleaning sheet 1C in the length direction thereof, as illustrated in FIGS. 8 and 9. As a result, at each of the opposite ends of the cleaning sheet 1C in the length direction thereof, the fiber-joining sections 32 are formed as two parallel discontinuous straight lines extending in the orthogonal direction (X direction) to the orientation direction of the long fibers 31.

Because the cleaning sheet 1C has two parallel discontinuous straight lines consisting of the fiber joining sections 32 at each of the opposite ends of the cleaning sheet 1C in the length direction thereof, a fiber ball 34, which looks linear in the width direction of the cleaning sheet 1C, is formed at each of the opposite ends of the cleaning sheet 1C in the length direction thereof, the fiber ball 34 being formed as a result of the cut fibers 311 becoming entangled due to three-dimensional opening. Meanwhile, in regions other than the opposite ends of the cleaning sheet 1C in the length direction thereof, a plurality of spherical fiber balls 34 are formed as a result of the cut fibers 311 becoming entangled around each fiber joining section 32, and these spherical fiber balls 34 are arranged in a staggered pattern.

The actions and effects of the above-described cleaning sheet 1C of the third embodiment of the present invention, when in use, will be described below.

The cleaning sheet 1C of the third embodiment, when attached to the head 41 of a cleaning tool 4, can be used for cleaning, such as sweeping (mopping) wooden-floored rooms, in the same way as ordinary mopping tools.

The cleaning sheet 1C of the third embodiment can achieve the same effects as those of the cleaning sheet 1A of the first embodiment. Effects that are different from those of the cleaning sheet 1A of the first embodiment will be described below.

In the cleaning sheet 1C of the third embodiment, a plurality of spherical fiber balls 34 are formed in a staggered pattern, and also, a fiber ball 34, formed by entanglement of the cut fibers 311 and extending linearly along the width direction, is formed at each end of the cleaning sheet 1C in the length direction thereof. Thus, compared to the cleaning sheet 1A or 1B, the configuration pattern of the long-fiber bundles 3 becomes more complex and thus the fiber balls 34 become more voluminous. The cleaning sheet also has an excellent aesthetic appearance as viewed from above.

Next, a cleaning sheet according to a fourth embodiment of the present invention will be described with reference to FIG. 10.

As for the cleaning sheet 1D of the fourth embodiment, the differences from the cleaning sheet 1A of the first embodiment will be described below. Matters that are not particularly described are the same as in the cleaning sheet 1A of the first embodiment, and the descriptions for the cleaning sheet 1A of the first embodiment apply as appropriate thereto.

Figure 10:
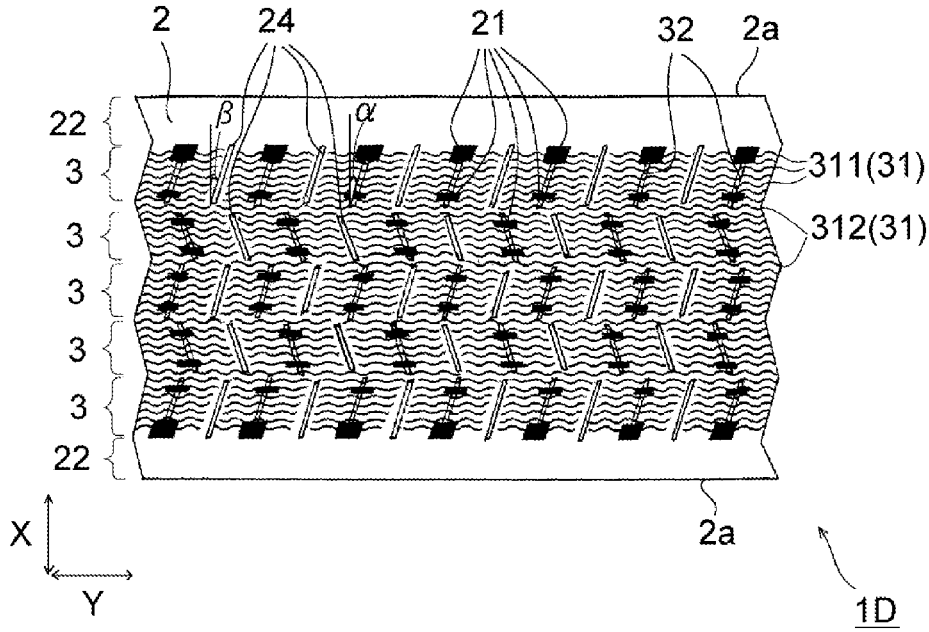
FIG. 10 is a plan view of a cleaning sheet according to a fourth embodiment of the invention.

As illustrated in FIG. 10, in the cleaning sheet 1D, the fiber-joining sections 32 of the long-fiber bundles 3 are formed so that they extend in a direction diagonally intersecting with the orthogonal direction (X direction) to the orientation direction of the long fibers 31. In the cleaning sheet 1D, five long-fiber bundles 3 are fixed to the substrate sheet 2 by sheet-joining sections 21 which are made long in the orientation direction of the long fibers 31 (Y direction). The cleaning sheet 1D also has uncut fibers 312, which have not been cut by the linear cut sections 24, in regions between the sheet-joining sections 21, 21 adjacent to one another in the orientation direction of the long fibers 31 (Y direction). As illustrated in FIG. 10, the opposite ends of the cleaning sheet 1D in the length direction thereof (Y direction) have been cut in a zigzag pattern.

As illustrated in FIG. 10, in the cleaning sheet 1D of the fourth embodiment, the fiber-joining sections 32 in the same long-fiber bundle 3 all intersect diagonally with the orthogonal direction (X direction) to the orientation direction of the long fibers 31 at the same inclination; and the fiber-joining section 32 in one long-fiber bundle 3 and the fiber-joining section 32 in an adjacent long-fiber bundle 3 are formed such that they diagonally intersect with the orthogonal direction (X direction) to the orientation direction of the long fibers 31 at symmetrical inclinations with respect to a straight line extending along the orientation direction of the long fibers 31 (Y direction).

Each fiber-joining section 32 intersects with a straight line extending along the orthogonal direction (X direction) to the orientation direction of the long fibers 31 preferably at an angle $\alpha$ (see FIG. 10) of 3° to 45°, more preferably at an angle $\alpha$ of 5° to 20°. Preferably, the fiber-joining sections 32 in the same long-fiber bundle 3 have the same angle $\alpha$.

Likewise, as illustrated in FIG. 10, the linear cut sections 24 for cutting the long-fiber bundles 3 are formed so that they diagonally intersect with the orthogonal direction (X direction) to the orientation direction of the long fibers 31. The linear cut sections 24 in the same long-fiber bundle 3 all intersect diagonally with the orthogonal direction (X direction) to the orientation direction of the long fibers 31 at the same inclination; and the linear cut section 24 in one long-fiber bundle 3 and the linear cut section 24 in an adjacent long-fiber bundle 3 are formed such that they diagonally intersect with the orthogonal direction (X direction) to the orientation direction of the long fibers 31 at symmetrical inclinations with respect to a straight line extending along the orientation direction of the long fibers 31 (Y direction).

Each linear cut section 24 intersects with a straight line extending along the orthogonal direction (X direction) to the orientation direction of the long fibers 31 preferably at an angle $\beta$ (see FIG. 10) of 3° to 45°, more preferably at an angle $\beta$ of 5° to 20°. Preferably, the linear cut sections 24 in the same long-fiber bundle 3 have the same angle $\beta$.

In the cleaning sheet 1D as illustrated in FIG. 10, in the three central long-fiber bundles 3 of the five long fibers 31 lined up in the width direction of the substrate sheet 2 (X direction), five linear cut sections 24 and six fiber-joining sections 32 are formed alternately in the length direction of the substrate sheet 2 (Y direction). Meanwhile, in the two long-fiber bundles 3 located on the outer sides of the substrate sheet 2 in the width direction thereof (X direction), six linear cut sections 24 and seven fiber-joining sections 32 are formed alternately in the length direction of the substrate sheet 2 (Y direction).

The cleaning sheet 1D of the fourth embodiment of the present invention, when attached to the head 41 of a cleaning tool 4, can be used for cleaning, such as sweeping (mopping) wooden-floored rooms, in the same way as ordinary mopping tools.

The cleaning sheet 1D of the fourth embodiment can achieve the same effects as those of the cleaning sheet 1A of the first embodiment. Effects that are different from those of the cleaning sheet 1A of the first embodiment will be described below.

In the cleaning sheet 1D of the fourth embodiment, the opposite ends in its length direction are formed in a zigzag pattern. Thus, these ends exhibit excellent conformability to small narrow regions where the floor connects to the walls. Also, each piece of cleaning sheet 1D, which is prepared by performing zigzag cutting in the later-described cleaning sheet forming step, can be made longer in terms of its entire length compared to other types of cleaning sheets (e.g., the cleaning sheet 1A of the first embodiment) made by linearly cutting the same amount of raw material into the same number of sheets, thereby resulting in a reduction of material or an increase in wiping area.

Further, the fiber-joining sections 32, the linear cut sections 24, and the opposite ends of the cleaning sheet 1D in the length direction thereof (Y direction) are all formed intersecting diagonally with a straight line extending along the orthogonal direction (X direction) to the orientation direction of the long fibers 31. Such a structure improves the processability and durability of production devices in cases where roller-shaped sealing devices and cutting devices are used for the various production steps.

Next, a cleaning sheet according to a fifth embodiment of the present invention will be described with reference to FIG. 11.

As for the cleaning sheet 1E of the fifth embodiment, the differences from the cleaning sheet 1D of the fourth embodiment will be described below. Matters that are not particularly described are the same as in the cleaning sheet 1D of the fourth embodiment, and the descriptions for the cleaning sheet 1D of the fourth embodiment apply as appropriate thereto.

Figure 11:
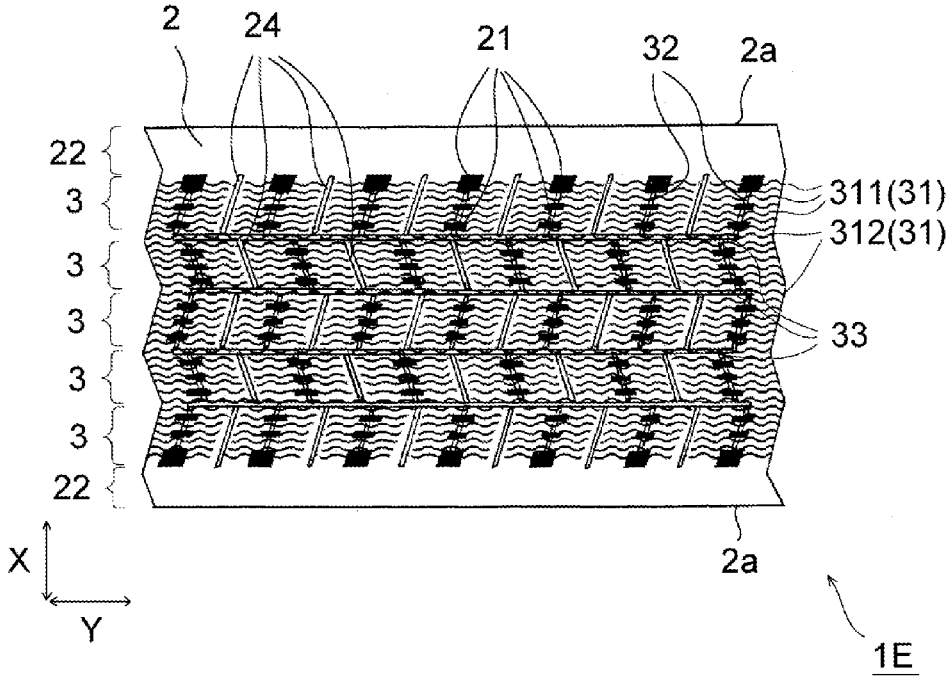
FIG. 11 is a plan view of a cleaning sheet according to fifth embodiment of the invention.

As illustrated in FIG. 11, in the cleaning sheet 1E of the fifth embodiment, the fiber-joining sections 32 of the long-fiber bundles 3 as well as the linear cut sections 24 for cutting the long-fiber bundles 3 are formed so that they intersect diagonally with the orthogonal direction (X direction) to the orientation direction of the long fibers 31, as in the cleaning sheet 1D. The linear cut sections 24 of the cleaning sheet 1E are formed between later-described fiber-joining lines 33 without coming into contact therewith. In the cleaning sheet 1E, five long-fiber bundles 3 are fixed to the substrate sheet 2 by sheet-joining sections 21 which are made long in the orientation direction of the long fibers 31 (Y direction). The long-fiber bundles 3 have uncut fibers 312, which have not been cut, in regions between the sheet-joining sections 21 of one long-fiber bundle 3 and the sheet-joining sections 21 of a long-fiber bundle 3 adjacent thereto.

In addition, the cleaning sheet 1E, fiber-joining lines 33 for joining the long fibers 31 are formed between each pair of adjacent long-fiber bundles 3 as illustrated in FIG. 11, the fiber-joining line 33 being formed parallel to the orientation direction of the long fibers 31 (Y direction) and extending from the vicinity of one end of the substrate sheet 2 in the length direction thereof (Y direction) to the vicinity of the other end thereof. Like the fiber-joining sections 32, the fiber-joining lines 33 are not for joining the long-fiber bundles 3 to the substrate sheet 2. As illustrated in FIG. 11, the cleaning sheet 1E has four fiber-joining lines 33, and each fiber-joining line 33 is connected with the lower ends (ends on the lower side in the X direction of FIG. 11) of the fiber-joining sections 32 in one long-fiber bundle 3 and the upper ends (ends on the upper side in the X direction in FIG. 11) of the fiber-joining sections 32 in an adjacent long-fiber bundle 3. Thus, the cleaning sheet 1E has long-fiber bundles 3 composed of long fibers 31 that are unfailingly joined by at least either the fiber-joining sections 32 or the fiber-joining lines 33, and thus, the uncut fibers 312 made by cutting the long fibers 31 with the linear cut sections 24 are joined to at least one of the fiber-joining sections 32 or the fiber-joining lines 33. Note that the present fiber-joining lines 33 are formed in the later-described "long-fiber bundle forming step," and they may be formed using a first heat embossing device 51 or a separate embossing device provided before or after the embossing device 51.

As illustrated in FIG. 11, the cleaning sheet 1E has three sheet-joining sections 21 for each fiber-joining section 32. The sheet-joining sections 21 are made long in the orientation direction of the long fibers 31.

In the cleaning sheet 1E of the fifth embodiment, the fiber-joining lines 33 inhibit the long fibers 31 and the substrate sheet 2 from extending during use of the cleaning sheet 1E, thus increasing the overall rigidity of the cleaning sheet 1E. Due to the increase in the overall rigidity of the cleaning sheet 1E, the substantially spherical fiber balls 34 exhibit a greater frictional force with the surface-to-be-cleaned, thus improving the dirt trapping capabilities.

Further, because the fiber-joining lines 33 are connected to the fiber joining sections 32, there are no free long fibers 31 in the cleaning sheet, and thus it is possible to prevent fibers from falling off from areas between the linear cut sections 24 adjacent to one another in the orientation direction of the long fibers (Y direction) when there is undulation in the long fibers 31. Furthermore, because the fiber-joining lines 33 are connected to the fiber-joining sections 32, the long-fiber bundles 3 become connected also in the width direction of the substrate sheet 2 (X direction), which improves the stability in the later-described "long-fiber bundle supplying step".

Next, a preferred embodiment of a process for producing a cleaning sheet of the invention will be described with reference to FIG. 12. The following is an example of producing the cleaning sheet 1A of the first embodiment illustrated in FIGS. 1 to 4.

In the production process of the first embodiment, a cleaning sheet 1A is produced through the following steps (1) to (5):

(1) Long-fiber bundle forming step;

(2) Long-fiber bundle supplying step;

(3) Laminate forming step;

(4) Cut section forming step; and (5) Cleaning sheet forming step.

Figure 12:
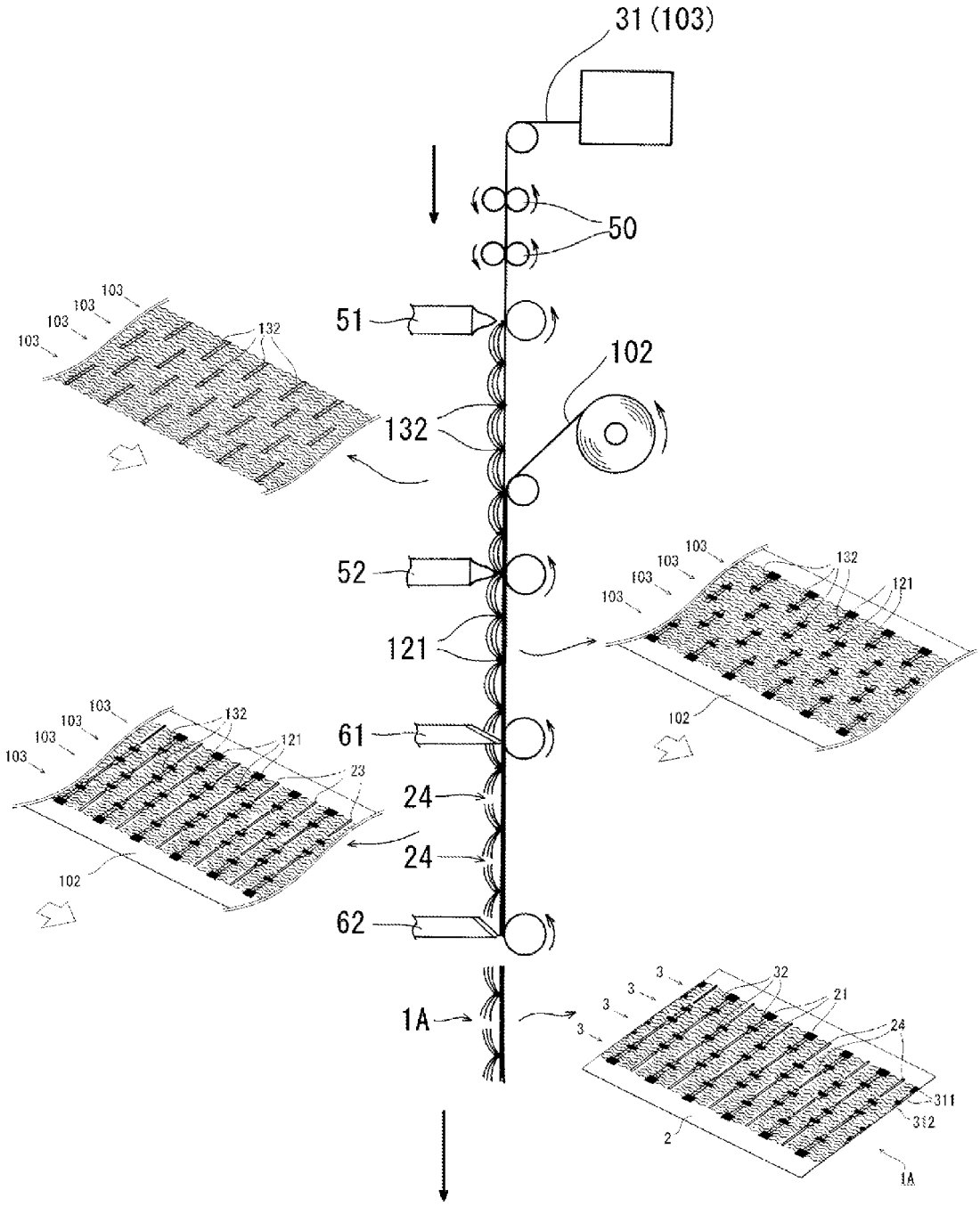
FIG. 12 is a schematic diagram illustrating an overview of an embodiment of a process for producing a cleaning sheet of the invention.

(1) Long-Fiber Bundle Forming Step:

As illustrated in FIG. 12, in this step, an aggregate of long fibers 31 oriented in one direction is paid out, the aggregate is widened in a predetermined width direction with a widening roller 50, and the long fibers 31 are joined together by forming fiber-joining sections 32 extending in a direction orthogonal to the orientation direction of the long fibers 31 (the carrying direction of the long fibers 31), to form an integrated, continuous strip 103 of long-fiber bundles 3. The cleaning sheet 1A has four long-fiber bundles 3 on each side; so, in order to achieve this structure, four continuous strips 103 of long-fiber bundles 3 are formed by: paying out the aggregate of long fibers 31, which are oriented in one direction, in the orientation direction of the long fibers 31 (the carrying direction of the long fibers 31); making the aggregate into a belt-like form by widening and opening the same with the widening roller 50 to a width amounting to four continuous strips 103 of long-fiber bundles for the cleaning sheet 1A; and forming the aforementioned fiber-joining sections 32 therein.

As illustrated in FIG. 12, in the present step, continuous sealing lines 132 are formed, extending substantially continuously in a direction orthogonal to the carrying direction of the four continuous strips 103 of long fibers 31 (i.e., to the orientation direction of the long fibers 31). The continuous sealing lines 132 are formed by performing pressing with a first heat embossing device 51 and are formed intermittently in the carrying direction of the continuous strips of the long fibers 31 that have been paid out. These continuous sealing lines 132 overlap the fiber-joining sections 32, and the distances between the continuous sealing lines 132 correspond to the distances between the fiber-joining sections 32 adjacent to one another in the orientation direction of the long fibers 31 in the cleaning sheet 1A. The continuous sealing lines 132 are formed by known sealing means, such as heat sealing or ultrasonic sealing, so that they do not peel apart.

(2) Long-Fiber Bundle Supplying Step:

As illustrated in FIG. 12, in the present step, the continuous strips 103 of long-fiber bundles 3 formed in the long-fiber bundle forming step are supplied on at least one side of a nonwoven fabric 102 which is in the form of a continuous belt. Note that FIG. 12 only illustrates one long-fiber bundle forming step; however, in cases where the long-fiber bundles 3 are to be provided on both sides of the substrate sheet 2 in the cleaning sheet 1A, two long-fiber bundle forming steps may be provided accordingly. As illustrated in FIG. 12, the continuous belt-form nonwoven fabric 102 is wound off, and the continuous strips of long-fiber bundles 3 are supplied in the same direction as the orientation direction of the long fibers 31 (the carrying direction of the long fibers 31) onto both sides of the belt-form nonwoven fabric 102. In doing so, the continuous strips are supplied such that the positions of the continuous sealing lines 132 on the continuous strips of long-fiber bundles 3 provided on one side of the belt-form nonwoven fabric 102 and the positions of the continuous sealing lines 132 of the same on the other side of the nonwoven fabric 102 coincide with one another in the orientation direction of the long fibers 31 (the carrying direction of the long fibers 31). Note that the nonwoven fabric 102 becomes the substrate sheet 2.

(3) Laminate Forming Step:

As illustrated in FIG. 12, in this step, the continuous strips 103 of long-fiber bundles 3 are joined to the belt-like nonwoven fabric 102 by sealing lines 121, to form a continuous laminate. The sealing lines 121 are formed by performing pressing with a second heat embossing device 52 and are formed intermittently in the orientation direction of the long fibers 31. These sealing lines 121 become the sheet-joining sections 21, and the distances between the sealing lines 121 correspond to the distances between the sheet joining sections 21 adjacent to one another in the orientation direction of the long fibers 31 in the cleaning sheet 1A. Also, the sealing lines 121 are formed to be long in the orientation direction of the long fibers 31, as illustrated in FIG. 12, so as to correspond to the sheet-joining sections 21 in the cleaning sheet 1A, and the sealing lines 121 are formed so as to contact the continuous sealing lines 132 orthogonally. Two sealing lines 121 are formed for each continuous sealing line 132 so as to correspond to the sheet joining sections 21 in the cleaning sheet 1A. The sealing means for the sealing lines 121 is the same as that for the continuous sealing lines 132.

(4) Cut Section Forming Step:

As illustrated in FIG. 12, in this step, linear cut sections 24 are formed in respective regions between the continuous sealing lines 132 adjacent to one another in the orientation direction of the long fibers 31 (the carrying direction of the long fibers 31). In this step, as illustrated in FIG. 12, the linear cut sections 24 are formed in the continuous laminate by cutting the long fibers 31 by performing pressing, with a first cutter 61, in regions between adjacent continuous sealing lines 132, 132 along the direction orthogonal to the orientation direction of the long fibers 31 (i.e., to the carrying direction of the long fibers 31); this results in forming cut fibers 311 as well as uncut fibers 312 in the continuous strips of the long-fiber bundles 3.

(5) Cleaning Sheet Forming Step:

As illustrated in FIG. 12, in this step, the continuous laminate is cut into predetermined lengths to form separate cleaning sheets 1A. In this step, as illustrated in FIG. 12, the continuous laminate is cut along the direction orthogonal to the orientation direction of the long fibers 31 (i.e., to the carrying direction of the long fibers 31) by being pressed with a second cutter 62, to thus consecutively obtain cleaning sheets 1A each having long-fiber bundles 3 on both sides of a substrate sheet 2, with four long-fiber bundles 3 per side thereof.

The process for producing the cleaning sheet 1A preferably includes the following step (6).

(6) Step of Three-Dimensionally Opening the Long Fibers so that they are Fluffed Three-Dimensionally and Randomly:

This step is performed between the cut section forming step (4) and the cleaning sheet forming step (5). In this step, the cut fibers 311 in the continuous strips of the long-fiber bundles 3 are subjected to air-blowing and vacuum treatment, to fluff the cut fibers 311 randomly and three-dimensionally and form the fiber balls 34 (see FIG. 4).

The cleaning sheet 1B of the second embodiment illustrated in FIG. 6 and the cleaning sheet 1C of the third embodiment illustrated in FIG. 8 can be produced by changing the positions at which the continuous sealing lines 132 are formed by the first heat embossing device 51 in the long-fiber bundle forming step (1) in the production process of the first embodiment to the positions corresponding to the fiber-joining sections 32 of the cleaning sheet 1B, and by changing the positions at which the first cutter 61 performs cutting in the cut section forming step (4) of the production process of the first embodiment to the positions corresponding to the linear cut sections 24 of the cleaning sheet 1B.

The cleaning sheet of the present invention is not limited to the foregoing cleaning sheet of the first, second, or third embodiment and may be modified as appropriate. Further, the features of the cleaning sheet of the first, second, or third embodiment may be combined as appropriate without departing from the gist of the invention.

For example, in the cleaning sheets 1A, 1B, and 1C of the first, second, and third embodiments, the fiber-joining sections 32 and the linear cut sections 24 are formed extending in the direction orthogonal to the orientation direction of the long fibers 31 as illustrated in FIGS. 1, 6, and 8; however, they only need to intersect with the orientation direction of the long fibers 31.

Further, in the cleaning sheets 1A, 1B, and 1C of the first, second, and third embodiments, the long-fiber bundles 3 are provided on both sides of the substrate sheet 2 as illustrated in FIGS. 1, 6, and 8; however, the long-fiber bundles 3 can be provided only on one side of the substrate sheet 2.

Further, in the cleaning sheets 1A, 1B, and 1C of the first, second, and third embodiments, the sheet-joining sections 21 are made long in the orientation direction of the long fibers as illustrated in FIGS. 1, 6, and 8; however, they do not necessarily have to be made long, as long as they are provided on the fiber-joining sections 32. Further, the sheet-joining sections 21 may be made to have dimensions differing from one another.

Further, in the cleaning sheets 1A, 1B, and 1C of the first, second, and third embodiments, the substrate sheet 2 is also cut by the linear cut sections 24 at the same positions as where the long-fiber bundles 3 have been cut as illustrated in FIGS. 1, 6, and 8; however, the substrate sheet 2 does not have to be cut.

Further, in the cleaning sheets 1A, 1B, and 1C of the first, second, and third embodiments, the fiber balls 34 are formed by three-dimensional opening as illustrated in FIG. 4; however, three-dimensional opening does not necessarily have to be performed.

Furthermore, in the cleaning sheets 1A and 1B of the first and second embodiments, the distances d2 between adjacent straight lines SL1 and the distances d3 between adjacent straight lines SL2 adjacent to one another in the orientation direction of the long fibers 31 are substantially even, as illustrated in FIGS. 1 and 6; however, the distances may be varied. For example, the distances may gradually be widened toward the opposite ends in the length direction of the cleaning sheet.

INDUSTRIAL APPLICABILITY

With the cleaning sheet of the present invention, the degree of freedom between the substrate sheet and the long-fiber bundles is not limited by the joining sections, and thus the dirt trapping capabilities are improved. Further, the overall strength of the cleaning sheet and the voluminosity of the long fibers are less prone to deteriorate even when the long fibers are cut.

The invention claimed is:

1. A cleaning sheet comprising: a substrate sheet; and a plurality of long-fiber bundles provided on at least one side of the substrate sheet, each said long-fiber bundle being made by aggregating long fibers oriented in substantially one direction, the long-fiber bundles being arranged side-by-side and joined to the substrate sheet, wherein:

each said long-fiber bundle is formed by joining the long fibers together with a plurality of fiber-joining sections each extending linearly in a direction intersecting with the orientation direction of the long fibers, and each said long-fiber bundle is joined to the substrate sheet by a plurality of sheet joining sections;

each said sheet-joining section is provided so as to overlap a portion of one of the fiber-joining sections;

each said long-fiber bundle has been cut by a plurality of linear cut sections, each said linear cut section being formed in a region between adjacent said sheet joining sections which are adjacent to one another in the orientation direction of the long fibers, and each said long-fiber bundle includes cut fibers which are said long fibers that have been cut by the linear cut sections and also includes uncut fibers, which have not been cut, in the vicinity of the linear cut sections; and the substrate sheet is cut by the linear cut sections at the same positions as where the long-fiber bundles have been cut.

2. The cleaning sheet according to claim 1, wherein the uncut fibers are fibers that are not joined to the substrate sheet.

3. The cleaning sheet according to claim 1, wherein each said sheet-joining section is made long in the orientation direction of the long fibers.

4. The cleaning sheet according to claim 1, wherein:

the fiber-joining sections and the linear cut sections in the long-fiber bundles are arranged alternately in the direction intersecting with the orientation direction of the long fibers so as to form a plurality of continuous straight lines extending along said direction; and the fiber-joining sections and the linear cut sections are arranged alternately in the orientation direction of the long fibers.

5. The cleaning sheet according to claim 1, wherein:

the fiber joining sections in the long-fiber bundles are arranged so as to form a plurality of continuous straight lines in the direction intersecting with the orientation direction of the long fibers;

the linear cut sections in the long-fiber bundles are arranged so as to form a plurality of discontinuous straight lines in the direction intersecting with the orientation direction of the long fibers; and the fiber-joining sections and the linear cut sections are arranged alternately in the orientation direction of the long fibers.

6. The cleaning sheet according to claim 1, wherein:

the substrate sheet has a rectangular shape which is long in the orientation direction of the long fibers;

the cleaning sheet has at least three, odd number of said long-fiber bundles;

the fiber-joining sections in odd-numbered long-fiber bundles, as counted from a side edge of the substrate sheet extending along a length direction thereof, are provided on a plurality of first imaginary straight lines which are parallel to the direction intersecting with the orientation direction of the long fibers, whereas the fiber joining sections in even-numbered long-fiber bundles, as counted from the side edge of the substrate sheet extending along the length direction thereof, are provided on a plurality of second imaginary straight lines which are parallel to the direction intersecting with the orientation direction of the long fibers;

the first imaginary straight lines adjacent to one another in the orientation direction of the long fibers are provided at substantially even distances, the second imaginary straight lines adjacent to one another in the orientation direction of the long fibers are provided at substantially even distances, and the distance between adjacent said first imaginary straight lines is shorter than the distance between adjacent said second imaginary straight lines; and the fiber joining sections and the linear cut sections are arranged alternately in the orientation direction of the long fibers.

7. The cleaning sheet according to claim 1, wherein a total area of the plurality of long-fiber bundles is wider than a bottom surface area of a head of a cleaning tool to which the cleaning sheet is to be attached.

8. The cleaning sheet according to claim 7, wherein:

the orientation direction of the long fibers, the length direction of the substrate sheet, and a length direction of the head of the cleaning tool coincide with one another; and when the cleaning sheet is attached to the head of the cleaning tool, the long-fiber bundles exist also on side surfaces of the head extending along the length direction thereof.

* * * * *